US012742276B2

(12) United States Patent
Kwon et al.

(10) Patent No.: US 12,742,276 B2
(45) Date of Patent: Sep. 22, 2026

(54) WASHING MACHINE AND CLOTHING TREATMENT APPARATUS

(71) Applicant: SAMSUNG ELECTRONICS CO., LTD., Suwon-si (KR)

(72) Inventors: Baekgyu Kwon, Suwon-si (KR); Kwangmin Chun, Suwon-si (KR); Eunyoung Park, Suwon-si (KR); Doyun Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 133 days.

(21) Appl. No.: 18/782,819

(22) Filed: Jul. 24, 2024

(65) Prior Publication Data

US 2024/0376656 A1 Nov. 14, 2024

Related U.S. Application Data

(63) Continuation of application No. PCT/KR2023/000163, filed on Jan. 4, 2023.

(30) Foreign Application Priority Data

Feb. 25, 2022 (KR) ..... 10-2022-0025530

(51) Int. Cl.

| | |
|---|---|
| ***D06F 39/02*** | (2006.01) |
| ***D06F 39/08*** | (2006.01) |
| ***D06F 39/12*** | (2006.01) |

(52) U.S. Cl.

CPC ..... *D06F 39/022* (2013.01); *D06F 39/083* (2013.01); *D06F 39/12* (2013.01)

(58) Field of Classification Search

CPC ..... D06F 39/022

See application file for complete search history.

(56) References Cited

U.S. PATENT DOCUMENTS

| | | | |
|---|---|---|---|
| 10,077,527 | B2 | 9/2018 | Back et al. |
| 10,415,173 | B2 | 9/2019 | Seo et al. |

(Continued)

FOREIGN PATENT DOCUMENTS

| | | |
|---|---|---|
| JP | 6-36567 | 5/1994 |
| JP | 2020-185473 | 11/2020 |

(Continued)

OTHER PUBLICATIONS

International Search Report dated Apr. 26, 2023 issued in PCT Application No. PCT/KR2023/000163.

(Continued)

*Primary Examiner* — Jason Y Ko

(74) *Attorney, Agent, or Firm* — STAAS & HALSEY LLP

(57) ABSTRACT

A washing machine includes a cabinet, a tub disposed within the cabinet, and a detergent supplier configured to supply detergent to the tub, wherein the detergent supplier includes a detergent container, and a detergent pump dockable with the detergent container, the detergent pump includes a first case including a detector having at least a portion located within the detergent container, an inlet portion formed to allow detergent to be introduced from the detergent container, and an outlet portion formed to allow the detergent introduced through the inlet portion to be discharged, a second case couplable to the first case, the second case including a terminal electrically connectable to the detector, and a pump configured to draw in detergent through the inlet portion and discharge the drawn-in detergent through the outlet portion.

15 Claims, 10 Drawing Sheets

(56) References Cited

U.S. PATENT DOCUMENTS

| | | | |
|---|---|---|---|
| 11,634,852 | B2 | 4/2023 | Choi et al. |
| 11,959,219 | B2 | 4/2024 | Jung et al. |
| 2016/0258106 | A1 | 9/2016 | Kim |
| 2020/0232134 | A1 | 7/2020 | Jung et al. |
| 2021/0062395 | A1 | 3/2021 | Jung et al. |
| 2021/0222344 | A1 | 7/2021 | Jung et al. |

FOREIGN PATENT DOCUMENTS

| | | |
|---|---|---|
| KR | 1995-0007066 | 6/1995 |
| KR | 10-0730939 | 6/2007 |
| KR | 10-1343712 | 12/2013 |
| KR | 10-2019-0044228 | 4/2019 |
| KR | 10-1992137 | 6/2019 |
| KR | 10-2020-0120199 | 10/2020 |
| KR | 10-2204006 | 1/2021 |
| KR | 10-2021-0027018 | 3/2021 |
| KR | 10-2021-0027090 | 3/2021 |
| KR | 10-2238355 | 4/2021 |
| KR | 10-2021-0071559 | 6/2021 |

OTHER PUBLICATIONS

Written Opinion dated Apr. 26, 2023 issued in PCT Application No. PCT/KR2023/000163.

WASHING MACHINE AND CLOTHING TREATMENT APPARATUS

CROSS REFERENCE TO THE RELATED APPLICATION

This application is a continuation application, filed under 35 U.S.C. § 111(a), of International Application PCT/KR2023/000163 filed Jan. 4, 2023, and is based on and claims priority under 35 U.S.C. § 119 to Korean Patent Applications No. 10-2022-0025530, filed on Feb. 25, 2022, in the Korean Intellectual Property Office, the disclosures of which are incorporated by reference herein in their entireties.

TECHNICAL FIELD

The disclosure relates to a washing machine and a clothing treating apparatus, and more particularly, to a washing machine and a clothing treating apparatus including a detergent supply device.

BACKGROUND ART

In general, washing machines are devices that use the driving force of a drive motor to agitate together laundry, water, and detergent placed in a tub, thereby allowing the laundry to be washed by mutual friction.

A detergent supply device is a device that allows the detergent to be uniformly mixed into the supplied water and to be supplied together during the process of supplying water into a tub of a washing machine. In the case where the detergent is a liquid detergent, the liquid detergent may be supplied directly into the tub.

The detergent supply device may include a detergent pump. The detergent pump is configured to enable detergent in a detergent container to be delivered to the tub.

The detergent supply device may include a detergent detection portion configured to detect the remaining amount of detergent in the detergent container. The detergent detection portion may detect when the detergent in the detergent container is low and display the detected information on a display of the washing machine.

DISCLOSURE

Technical Problem

The present disclosure is directed to a washing machine and a clothing treating apparatus capable of simplifying manufacturing processes.

Further, the present disclosure is directed to a washing machine and a clothing treating apparatus capable of reducing material costs.

Technical Solution

According to an embodiment of the disclosure, a washing machine includes a cabinet, a tub disposed within the cabinet, and a detergent supplier configured to supply detergent to the tub, wherein the detergent supplier includes a detergent container, and a detergent pump dockable with the detergent container, the detergent pump includes a first case including a detector having at least a portion located within the detergent container, an inlet portion formed to allow detergent to be introduced from the detergent container, and an outlet portion formed to allow the detergent introduced through the inlet portion to be discharged, a second case couplable to the first case, the second case including a terminal electrically connectable to the detector, and a pump configured to draw in detergent through the inlet portion and discharge the drawn-in detergent through the outlet portion.

The detergent pump may include a pump connector electrically connected to the terminal and mounted on the pump.

The pump may include a pump motor configured to generate power to draw in detergent through the inlet portion and discharge the drawn-in detergent through the outlet portion, and the pump connector may be electrically connected to the pump motor.

The detergent pump may include a sensing wire disposed within the detergent pump to electrically connect the terminal and the pump connector, and a pump wire disposed within the detergent pump to electrically connect the pump motor and the pump connector.

The terminal may include a detector insertion portion located at one end of the terminal and into which the detector is inserted, and a wire fixing portion located at on an other end of the terminal opposite to one end where the detector insertion portion is located and fixing the sensing wire.

The detector may be configured to detect a remaining amount of detergent in the detergent container based on current being generated by the pump connector.

The first case may include a connection portion connecting the inlet portion and the outlet portion, and the second case may include a guide portion that, together with the connection portion, forms a connection passage that guides the detergent introduced through the inlet portion to the outlet portion.

The detergent pump may include a passage sealer configured to seal the connection passage formed between the connection portion and the guide portion.

The detergent supplier may include a housing having an opening that allows the detergent container to be inserted and removed, and the detergent pump may be mounted on the housing.

The outlet portion may discharge the detergent introduced through the inlet portion into the housing.

The terminal may include at least one support protrusion protruding from an inner circumferential surface into which the detector is inserted, the at least one support protrusion to contact the detector to conduct current to the detector.

The detergent container may include a detection hole formed to allow the detector to pass through, and the detergent pump may include a hole sealer configured to seal the detection hole.

The pump may include a pump motor and a pumping portion configured to perform a pumping motion while the pump motor is operating, and the second case may include a pumping hole formed to communicate with the pumping portion.

The second case may include a terminal mounting portion on which the terminal is mounted, and the terminal may include a terminal support portion formed to support the terminal mounting portion.

According to an embodiment of the disclosure, a clothing treating apparatus includes a tub, and a detergent supplier configured to supply detergent to the tub, wherein the detergent supplier includes a detergent container, and a detergent pump dockable with the detergent container, wherein the detergent pump includes a first case including a detector having at least a portion located within the detergent container based on the detergent pump being docked with the detergent container, and an inlet portion formed to allow detergent to be introduced from the detergent container, a second case couplable to the first case, the second case including a terminal electrically connectable to the detector, a pump configured to draw in detergent through the inlet portion, and a pump connector configured to provide power to the terminal and the pump.

The pumping device may include a pumping portion for providing an intake force to the inlet portion and a pump motor for driving the pumping portion, wherein the pump connector may be configured to provide power to the pump motor.

The second case may include a pumping hole formed to communicate with the pumping portion.

The detergent pump may include a sensing wire disposed within the detergent pump to electrically connect the terminal and the pump connector, and a pump wire disposed within the detergent pump to electrically connect the pump motor and the pump connector.

The first case may include an outlet portion for discharging the detergent entering from the inlet portion and a connection portion connecting the inlet portion and the outlet portion, and the second case may include a guide portion that, together with the connection portion, forms a connection passage that guides the detergent introduced through the inlet portion to the outlet portion.

The detecting member may be configured to detect a remaining amount of detergent in the detergent container when current is generated by the pump connector.

Advantageous Effects

According to the spirit of the present disclosure, the washing machine and clothing treating apparatus may have relatively simple components for providing power to a detecting member for detecting a level of detergent in a detergent container, thereby simplifying the manufacturing processes.

According to the spirit of the present disclosure, the washing machine and clothing treating apparatus may reduce the number of components for detecting the remaining amount of detergent in a detergent container, thereby reducing material costs.

MODES OF THE INVENTION

Figure 1:
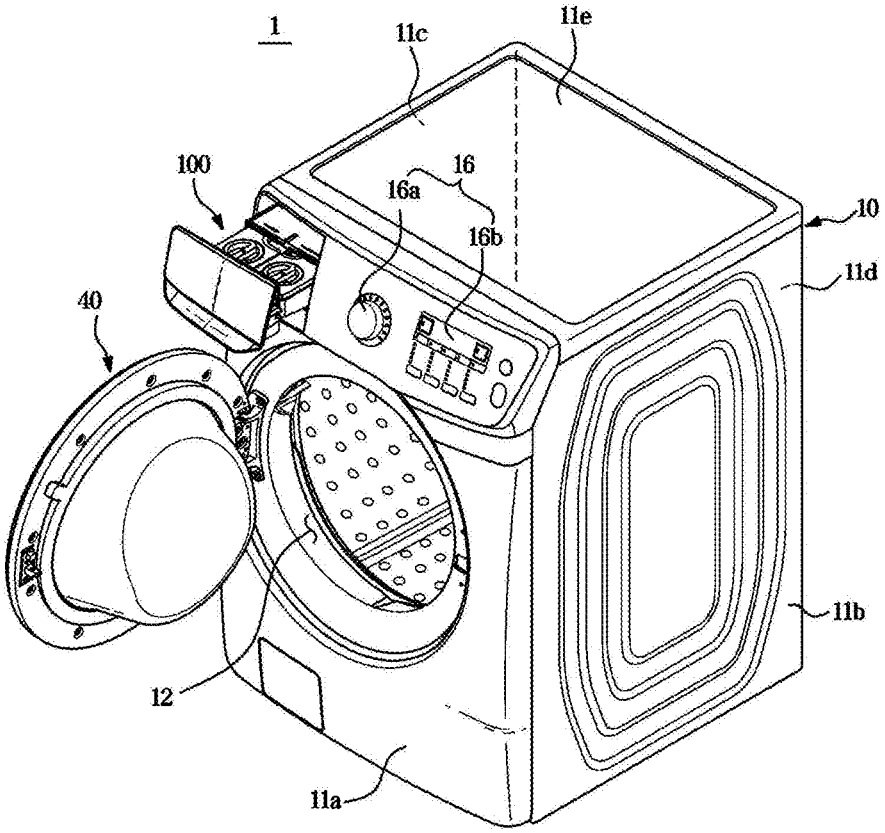
FIG. 1 is a view illustrating a washing machine according to an embodiment of the present disclosure.

Various embodiments of the present document and terms used therein are not intended to limit the technical features described in this document to specific embodiments, and should be understood to include various modifications, equivalents, or substitutes of the corresponding embodiments.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, figures, steps, operations, elements, components, or combinations thereof, but do not preclude the presence or addition of one or more of the features, figures, steps, operations, elements, components, or combinations thereof.

It will be understood that, although the terms "first", "second", "primary", "secondary", etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

As used herein, the terms "front", "rear", "upper", "lower", "left", "right", and the like are defined with reference to the drawings and are not intended to limit the shape and location of each component.

Hereinafter, various embodiments according to the disclosure will be described in detail with reference to the accompanying drawings.

Figure 2:
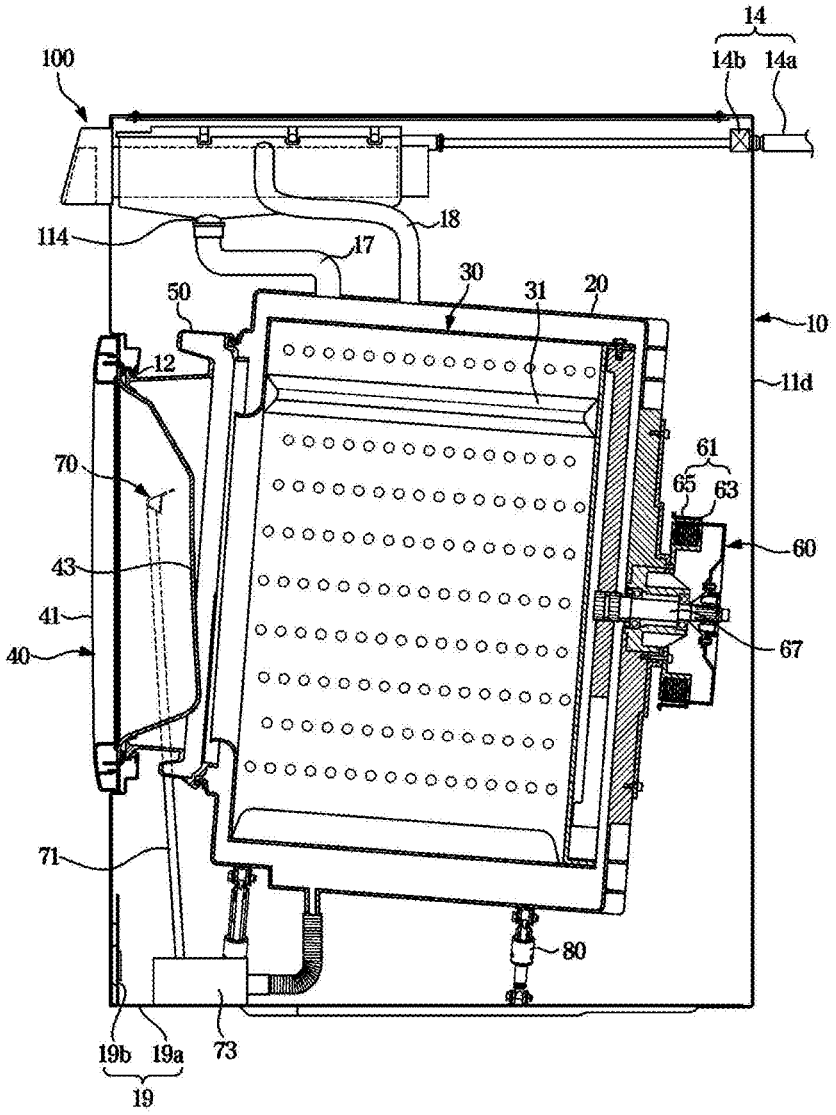
FIG. 2 is a cross sectional view of the washing machine shown in FIG. 1.

FIG. 1 shows a washing machine according to an embodiment of the present invention. FIG. 2 shows a cross section of the washing machine shown in FIG. 1.

Hereinafter, a direction in which a detergent container 120 of a detergent supply device or a detergent supplier 100 is withdrawn from a housing 110 may be defined as front, and rear, left and right sides, and upper and lower sides may be defined based on the above direction.

Furthermore, for ease of description, only a washing machine 1, which is an example of a clothing treating apparatus, will be described herein. However, the detergent supply device 100 may be used in clothing treating apparatus other than the washing machine 1.

As shown in FIGS. 1 and 2, the washing machine 1 may include a cabinet 10 forming an exterior thereof and accommodating various components therein, a tub 20 provided in an interior of the cabinet 10 to store mixed water containing water and detergent, a drum 30 provided in the interior of the tub 20 to receive and rotate laundry, a drive device 60 to rotate the drum 30, and the detergent supply device 100 to supply detergent to the tub 20.

The cabinet 10 may be formed in a substantially hexahedral shape. The cabinet 10 may be formed in the shape of a box having an open front. The cabinet 10 may include a front panel 11*a* disposed on the open front, side panels 11*b* and 11*c* disposed on both sides behind the front panel 11*a*, and a rear panel 11*d* disposed on a rear side of the cabinet 10. In an embodiment of the present disclosure, the cabinet 10 is shown as an example in which the rear panel 11*d* and the side panels 11*b* and 11*c* may be formed integrally, but the spirit of the present disclosure is not limited thereto. The cabinet 10 may include a base 19 provided at a bottom and a top cover 11*e* provided at an upper portion.

A control panel 16 may be provided on a front surface of the cabinet 10, including an inputter 16*a* that receives an operation command from a user and a display 16*b* that displays operation information of the washing machine.

The base 19 may include a lower frame 19*a* formed to cover a lower portion of the cabinet 10 and a lower reinforcing frame 19*b* formed by extending from the lower frame 19*a*.

An opening 12 may be formed in the front panel 11*a* to allow laundry to be inserted into the drum 30. The tub 20 and the drum 30 may have openings formed therein to allow laundry to be loaded into or unloaded from a front side of the cabinet 10, and the openings in the tub 20 and the drum 30 may be positioned corresponding to the opening 12 in the front panel 11*a*.

The opening 12 disposed in the front panel 11*a* may be opened or closed by a door 40. The door 40 may be rotatably mounted to the front panel 11*a* of the cabinet 10 by a hinge member (not shown). The door 40 may include a door frame 41 and a door glass 43. The door glass 43 may be formed of a transparent tempered glass material to allow the interior of the cabinet 10 to be viewed.

A water supply device 14 including a water supply pipe 14*a* and a water supply valve 14*b* for controlling the water supply may be provided on an upper portion of the tub 20. In addition, the detergent supply device 100 may be installed on the front upper portion of the tub 20 to supply detergent into the interior of the tub 20 during the water supply process.

The detergent supply device 100 may be connected to the tub 20 via a supply pipe 17. Water supplied via the water supply pipe 14*a* may be mixed with detergent by the detergent supply device 100, and the mixed water containing water and detergent may be supplied to the interior of the tub 20. In the case where the detergent is a liquid detergent, the water supply pipe 14*a* may supply water directly to the interior of the tub 20 via a separate control valve (not shown), and the liquid detergent may be supplied to the interior of the tub 20 via the detergent supply device 100 and the detergent supply pipe (not shown).

The detergent supply device 100 may be connected to the tub 20 via through an air tube 18. The air tube 18 may be provided to allow air to flow in and/or out of the detergent supply device 100. As a result, the air tube 18 may prevent the pressure within the detergent supply device 100 from decreasing.

The drive device 60 may be provided on a rear side of the drum 30. The drive device 60 may be configured to rotate the drum 30 and may be arranged to rotate the drum 30 by transmitting a driving force generated by a drive motor 61 to a rotation shaft 67.

The motor 61 may include a stationary stator 63 and a rotor 65 that rotates in electromagnetic interaction with the stator 63 to convert an electrical force into a mechanical rotational force.

The tub 20 may receive mixed water containing water and detergent, and may be formed in a substantially cylindrical shape. The tub 20 may be fixed to the interior of the cabinet 10. The opening 12 of the front panel 11*a* and the tub 20 may be connected by a diaphragm 50.

The diaphragm 50 may be provided with a spray nozzle 70, which is connected to a circulation hose 71 and sprays the circulating mixed water into the interior of the drum 30, on one side. The spray nozzle 70 may be arranged to spray the mixed water uniformly over the laundry accommodated in the drum 30. The circulation hose 71 may be connected to a circulation pump 73 for pumping the mixed water stored in a lower portion of the tub 20.

The drum 30 may perform washing by rotating within the tub 20 to lift and drop the laundry. A plurality of lifters 31 may be provided in the drum 30.

A drainage device (not shown) including a drain pipe (not shown) for draining water within the tub 20, a drain valve (not shown), and the like may be installed in the lower portion of the tub 20.

The tub 20 may be arranged to be elastically supported from the cabinet 10 by springs (not shown) at the upper portion and dampers 80 at the lower portion. In other words, the springs and dampers 80 may be arranged to absorb vibration energy between the tub 20 and the cabinet 10 to dampen vibration as the vibration is transmitted to the tub 20 and the cabinet 10 during rotation of the drum 30.

Figure 3:
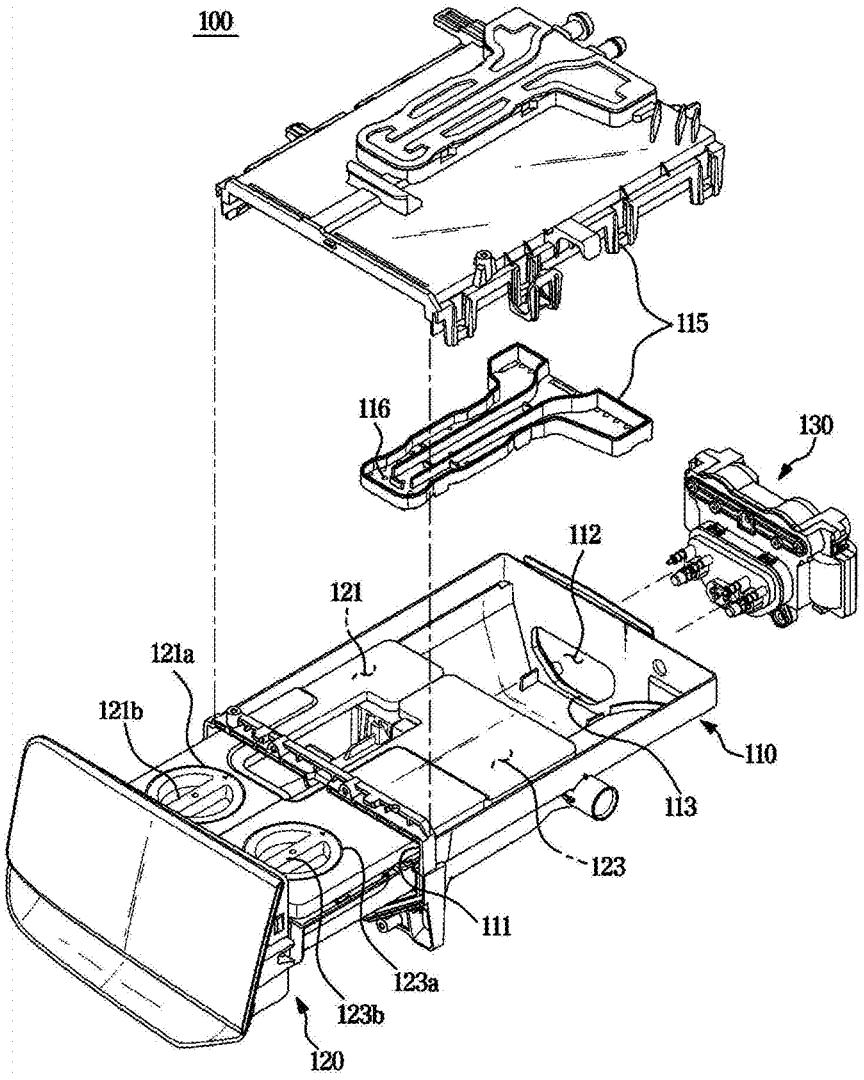
FIG. 3 is an exploded view illustrating some configurations of a detergent supply device shown in FIG. 1.
Figure 4:
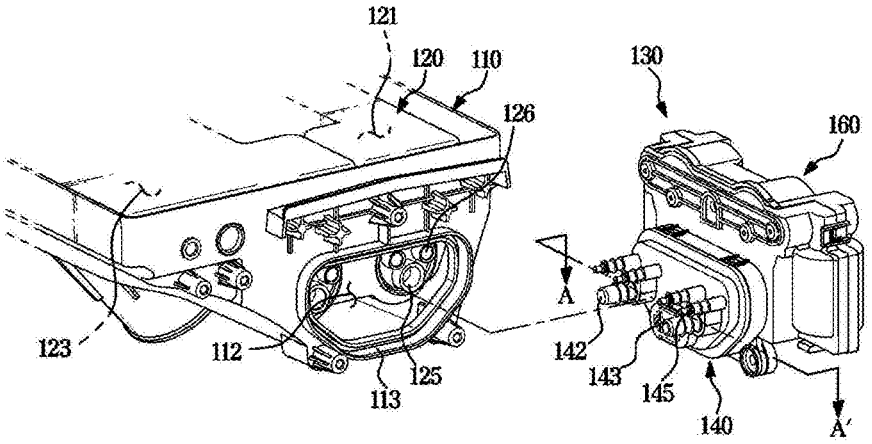
FIG. 4 is a view illustrating a coupling relationship between a housing and a detergent container and a detergent pump shown in FIG. 3.
Figure 5:
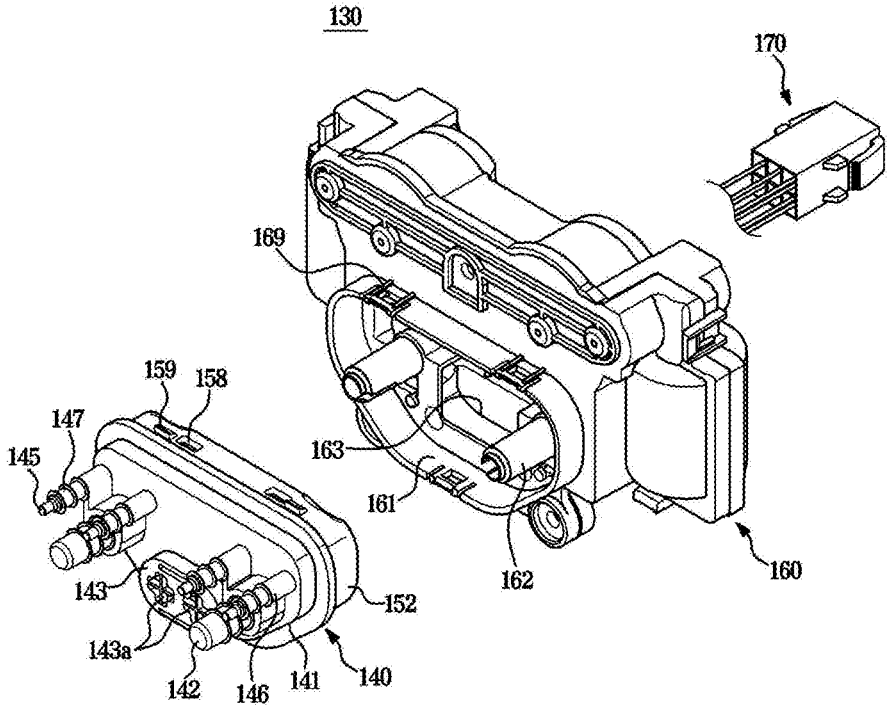
FIG. 5 is an exploded view illustrating some configurations of the detergent pump shown in FIG. 4.
Figure 6:
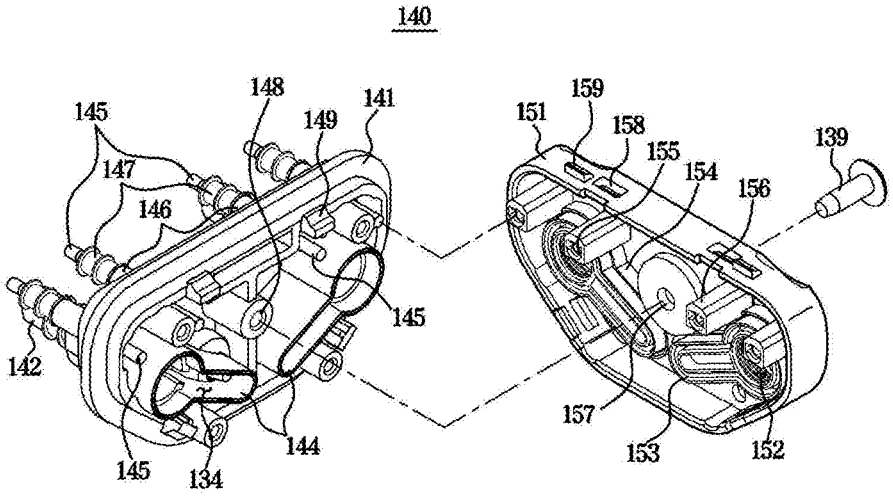
FIG. 6 is a view illustrating a first case and a second case shown in FIG. 5, disassembled.
Figure 7:
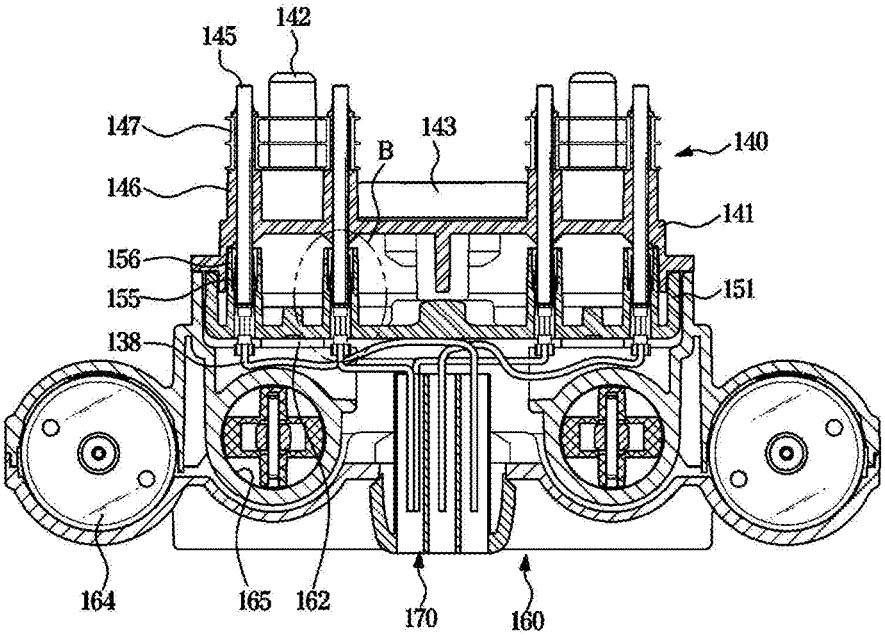
FIG. 7 is a cross sectional view taken along the line A-A' shown in FIG. 4.
Figure 8:
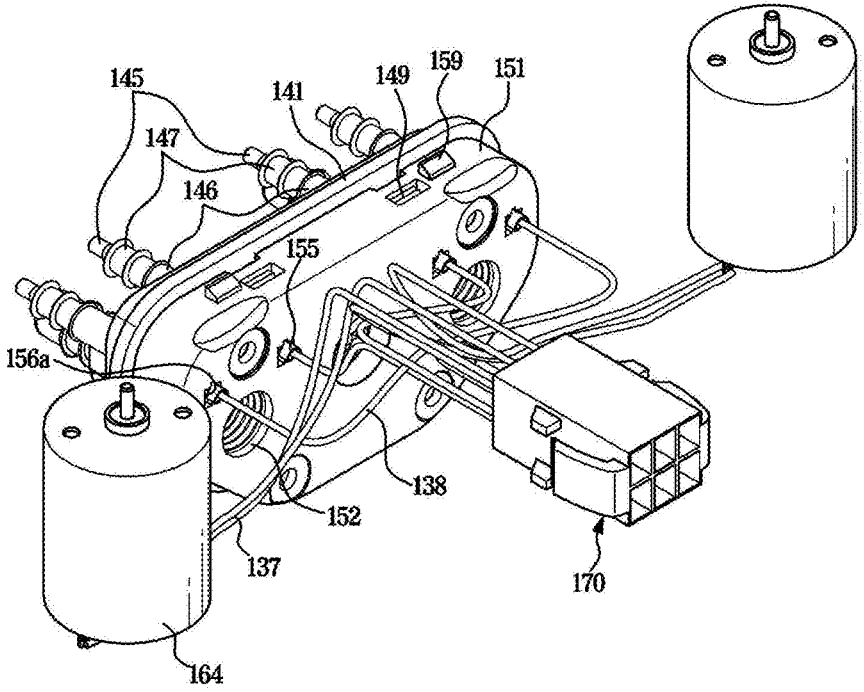
FIG. 8 is a view illustrating a connection structure of wires of the detergent pump shown in FIG. 4.
Figure 9:
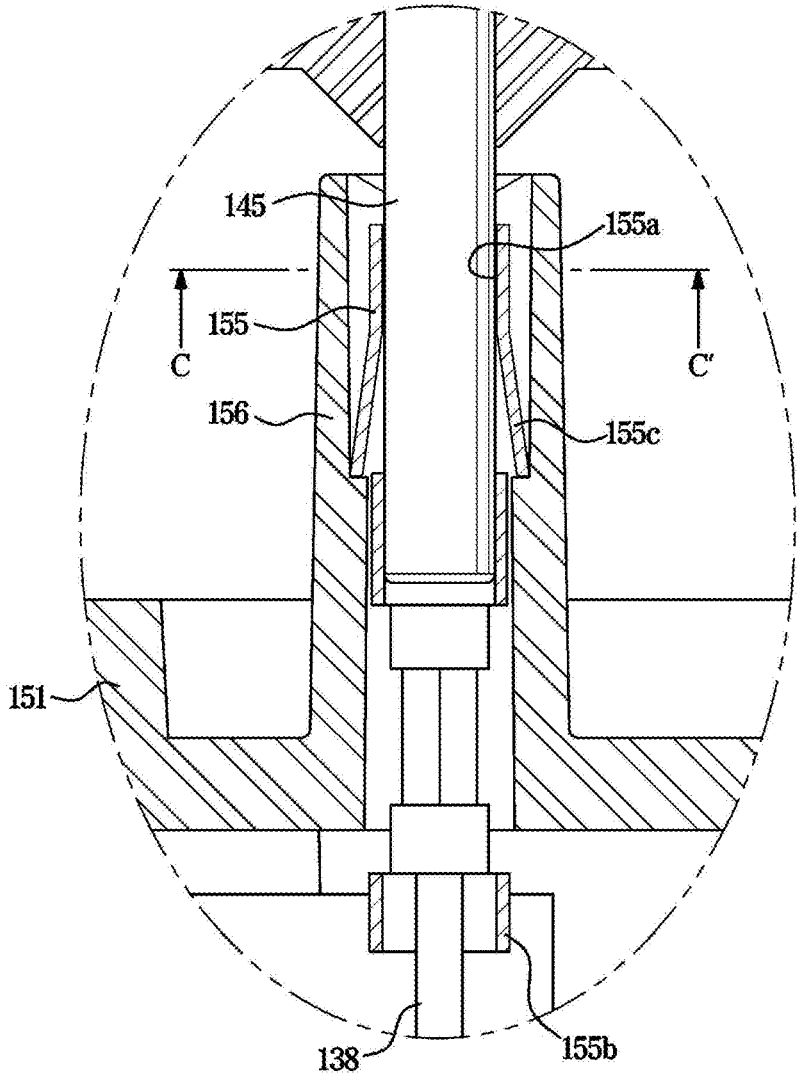
FIG. 9 is an enlarged view illustrating portion B shown in FIG. 7.
Figure 10:
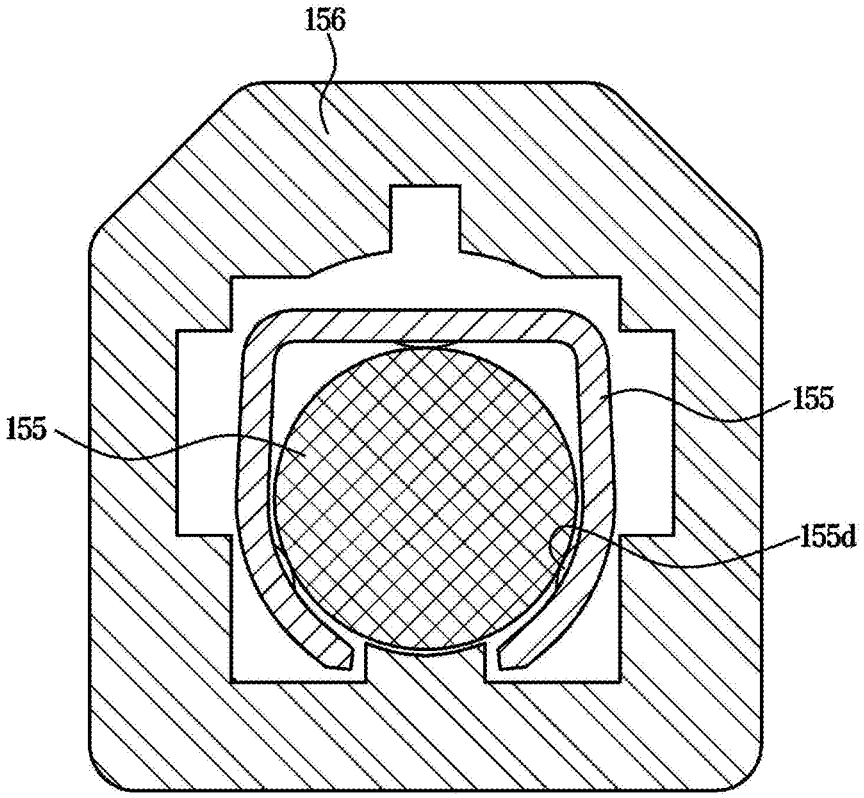
FIG. 10 is a cross sections view taken along the line C-C' shown in FIG. 9.

FIG. 3 is an exploded view of a partial configuration of the detergent supply device shown in FIG. 1. FIG. 4 shows the coupling relationship between a housing and a detergent container and the detergent pump shown in FIG. 3. FIG. 5 is an exploded view of a partial configuration of the detergent pump shown in FIG. 4. FIG. 6 is an exploded view showing a first case and a second case shown in FIG. 5 disassembled. FIG. 7 shows a cross section taken along the line A-A' shown in FIG. 4. FIG. 8 shows a connection structure of wires of the detergent pump shown in FIG. 4. FIG. 9 is an enlarged view showing portion B shown in FIG. 7. FIG. 10 shows a cross section taken along the line C-C' shown in FIG. 9.

Referring to FIG. 3, the detergent supply device 100 may be positioned on the upper portion of the tub 20 of the washing machine 1, and may include the housing 110 having an opening 111, the detergent container 120 that is inserted into and removed from the housing 110 through the opening 111, and a detergent pump 130 secured to the housing 110.

The housing 110 may include the opening 111 disposed on a front side for the detergent container 120 is inserted and removed, a pump opening 112 open for the detergent pump 130 secured to the housing 110 to be connected to the detergent container 120, an extension portion 113 extending from the pump opening 112 to allow a portion of the detergent pump 130 to be fitted and secured, a water supply portion 114 (see FIG. 2) for supplying detergent discharged by the detergent pump 130 from the detergent container 120 into an interior of the housing 110, together with water, into the tub 20, and a housing cover 115 covering an upper portion of the housing 110.

The detergent container 120, which stores detergent therein, may be drawn in and out of the housing 110 through the opening 111. When the detergent container 120 is drawn into the housing 110 through the opening 111, the detergent container 120 may be docked with the detergent pump 130.

The detergent container 120 may be docked to the detergent pump 130 through the pump opening 112 of the housing 110. When the detergent container 120 is docked with the detergent pump 130 through the pump opening 112, the detergent in the detergent container 120 may pass through the detergent pump 130 and may be discharged through the pump opening 112 to the interior of the housing 110.

The extension portion 113 may extend from the pump opening 112 toward a rear side of the pump opening 112. The detergent pump 130, which is secured to a rear side of the housing 110, may be secured by inserting a docking device 140, which will be described later, into the extension portion 113.

Referring to FIG. 2, the water supply portion 114 may disposed on a bottom of the housing 110. The water supply portion 114 may be connected to the tub 20 by the supply pipe 17. The detergent discharged from the detergent container 120 to the bottom of the housing 110 by the detergent pump 130 may be mixed with water and then be supplied to the tub 20 through the water supply portion 114.

The housing cover 115 may cover an open upper portion of the housing 110. The housing cover 115 may include a plurality of water supply holes 116 that supply water to the interior of the housing 110.

The detergent container 120 may be inserted into and removed from the housing 110 through the opening 111 of the housing 110. The detergent container 120 may store a main detergent (powder or liquid detergent), a pre-wash detergent, a fabric softener, and a bleach. The detergent container 120 may include a first detergent container 121 in which the main detergent is stored, and a second detergent container 123 in which the pre-wash detergent, the fabric softener, and the bleach are stored. For ease of description, the main detergent (powder or liquid detergent), the pre-wash detergent, the fabric softener, and the bleach are all be referred to herein as detergent. The first detergent container 121 may include a first inlet 121*a* for adding detergent into the first detergent container 121, and a first cover 121*b* for opening or closing the first inlet 121*a*. The second detergent container 123 may include a second inlet 123*a* for adding detergent into the second detergent container 123, and a second cover 123*b* for opening or closing the second inlet 123*a*.

Referring to FIG. 4, the detergent container 120 may include a detergent discharge portion 125 provided to discharge detergent stored in the detergent container 120. The detergent discharge portion 125 may be docked to the detergent pump 130. The detergent discharge portion 125 may be arranged to protrude from a rear side of the detergent container 120 so as to be docked with the detergent pump 130. The detergent container 120 may be docked with the detergent pump 130 and discharge detergent to the detergent pump 130 through the detergent discharge portion 125.

The detergent in the detergent container 120 may be discharged to the detergent pump 130 through the detergent discharge portion 125, and the detergent pump 130 may use the pressure difference at an inlet of the detergent discharge portion 125 to draw in the detergent in the detergent container 120 and discharge the drawn-in detergent into the housing 110.

The detergent container 120 may include a detection hole 126 through which a detecting member or a detector 145 of the detergent pump 130 is formed to pass. When the detergent container 120 is docked to the detergent pump 130, the detecting member 145 may be introduced into the interior of the detergent container 120 through the detection hole 126.

The detergent pump 130 may be secured to the rear side of the housing 110. The detergent pump 130 may include the docking device 140 and a pumping device or a pump 160.

Referring to FIGS. 4 to 6, the docking device 140 may be docked to the detergent container 120 when the detergent container 120 is inserted into the housing 110. The docking device 140 may include a first case 141 and a second case 151 coupled to the first case 141. The docking device 140 may be mounted on a docking mounting portion 161 of the pumping device 160.

The first case 141 may include an inlet portion 142 for introducing detergent from the detergent container 120. The inlet portion 142 may be provided to allow the detergent stored in the first detergent container 121 and the second detergent container 123 to enter. The inlet portion 142 may be arranged to correspond to the first detergent container 121 and the second detergent container 123.

The first case 141 may include an outlet portion 143 for exiting detergent into the housing 110. Discharge holes 143*a* may be formed in the outlet portion 143.

The first case 141 may include connection portion 144 connecting the inlet portion 142 and the outlet portion 143. The connection portion 144 may guide the detergent introduced through the inlet portion 142 to the outlet portion 143.

The first case 141 may include the detecting member 145 and a detecting member insertion portion 146 into which the detecting member 145 is inserted. The detecting member 145 may be arranged such that at least a portion of the detecting member 145 is located within the detergent container 120 when the detergent container 120 is inserted into the housing 110. The detecting member 145 may be configured to detect a remaining amount of detergent in the detergent container 120 when an electric current is generated.

The detecting member 145 may detect the remaining amount of detergent in the detergent container 120, and when the detergent is low, cause the display 16*b* of the washing machine 1 to display a notification that the detergent is low. When the display 16*b* indicates that the detergent is low, a user may undock the detergent container 120 from the detergent pump 130 and then remove the detergent container 120 from the housing 110 to replenish the detergent.

The detecting member 145 may be insert-injected or press-fitted into the first case 141.

The first case 141 may include a hole sealing member or a hole sealer 147 provided to cover an outer circumference of the detecting member insertion portion 146. The hole sealing member 147 may be configured to seal the detection hole 126 formed in the detergent container 120 for insertion of the detecting member 145 when the docking device 140 is docked to the detergent container 120.

The first case 141 may include a first fixing portion 148 and a first coupling portion 149 for coupling with the second case 151. When the first coupling portion 149 of the first case 141 is coupled to a second coupling portion 158 of the second case 151, the first fixing portion 148 of the first case 141 may be aligned with a second fixing portion 157 of the case 151. A case fixing member 139 may be inserted and/or coupled to the first fixing portion 148 and the second fixing portion 157, so that the first case 141 may be fixed to the second case 151. The first coupling portion 149 and the second coupling portion 158 may be coupled using a hook method.

The second case 151 may include a guide portion 154 that, together with the connection portion 144 of the first case 141, forms a connection passage 134 connecting the inlet portion 142 and the outlet portion 143. A pumping hole 152 connected to the pumping device 160 may be formed in a portion of the guide portion 154 close to the inlet portion 142. A pump cylinder 162 of the pumping device 160 may be inserted into the pumping hole 152.

A passage sealing member or a passage sealer 153 may be provided between the connection portion 144 of the first case 141 and the guide portion 154 of the second case 151. The passage sealing member 153 may seal between the connection portion 144 of the first case 141 and the guide portion 154 of the second case 151. The passage sealing member 153 may extend along a border of the connection portion 144 and the guide portion 154.

The second case 151 may include a terminal mounting portion 156 on which a terminal 155 is mounted. The terminal 155 may electrically connect the detecting member 145 arranged in the first case 141 and a pump connector 170. The terminal 155 and the terminal mounting portion 156 may be arranged to correspond to the detecting member 145.

Referring to FIGS. 7, 9, and 10, the terminal 155 may include a detecting member insertion portion 155*a* into which the detecting member 145 may be insertably formed. When the detecting member 145 is inserted into the terminal 155, the terminal 155 may include at least one support protrusion 155*d* protruding from an inner circumferential surface of the detecting member insertion portion 155*a*. The at least one support protrusion 155*d* may contact the detecting member 145 to energize the detecting member 145. In FIG. 10, three support protrusions 155*d* are shown along the inner circumferential surface of the detecting member insertion portion 155*a*, but the number of support protrusions 155*d* is not limited thereto.

The terminal 155 may include a wire fixing portion 155*b* provided at one end opposite to the other end where the detecting member insertion portion 155*a* is provided. The wire fixing portion 155*b* may be coupled to a sensing wire 138. When the sensing wire 138 is coupled to and comes into contact with the wire fixing portion 155*b*, the terminal 155 may be energized.

The terminal 155 may include a terminal support portion 155*c* that is inserted into the terminal mounting portion 156 and supported by the terminal mounting portion 156.

The second case 151 may include the second fixing portion 157 and the second coupling portion 158 for coupling with the first case 141. When the second coupling portion 158 of the second case 151 is coupled with the first coupling portion 149 of the first case 141, the second fixing portion 157 of the second case 151 may be aligned with the first fixing portion 148 of the case 141. The case fixing member 139 may be inserted and/or coupled to the second fixing portion 157 and the first fixing portion 148, so that the second case 151 may be fixed to the first case 141.

The second case 151 may include a device fixing portion 159. The device fixing portion 159 of the second case 151 may be coupled to a device coupling portion 169 provided in the pumping device 160. The device fixing portion 159 may be coupled to the device coupling portion 169 using a hook method.

The pumping device 160 may include the docking mounting portion 161 on which the docking device 140 is mounted. A connector mounting portion 163 for mounting the pump connector 170 may be formed in the docking mounting portion 161. The pump connector 170 mounted on the connector mounting portion 163 may be electrically connected to the docking device 140 mounted on the docking mounting portion 161. The pump connector 170 may be electrically connected to the terminal 155.

More particularly, referring to FIGS. 7 and 8, the pumping device 160 may include the sensing wire 138 extending from the pump connector 170 to the terminal 155. The sensing wire 138 may be arranged to correspond to the terminal 155. The sensing wire 138 may be disposed within the pumping device 160. The sensing wire 138 may be connected to the terminal 155 through a terminal hole 156*a* of the terminal mounting portion 156 formed on a rear surface of the second case 151.

The pumping device 160 may include the pump cylinder 162 inserted into the docking device 140. The pump cylinder 162 may transmit power for pumping generated by the pumping device 160 to the docking device 140. The pump cylinder 162 may be inserted into the pumping hole 152 formed in the second case 151 of the docking device 140.

The pumping device 160 may include a pump motor 164 and a pumping portion 165. The pump motor 164 may be electrically connected to the pump connector 170. The pump motor 164 may generate power to draw in detergent through the inlet portion 142 and discharge the drawn detergent through the outlet portion 143. The pump motor 164 may be supplied with power from the pump connector 170. The pump motor 164 may be electrically connected to the pump connector 170. While the pump motor 164 is operating, the pumping portion 165 may perform a pumping motion. As the pumping portion 165 performs the pumping motion, the detergent may be drawn in from the inlet portion 142 and discharged through the outlet portion 143.

More particularly, when the pump motor 164 is operated, the pumping portion 165 may perform the pumping motion. Upon performing the pumping motion of the pumping portion 165, the detergent in the detergent container 120 may be drawn in through the inlet portion 142. The detergent entering the detergent pump 130 through the inlet portion 142 may be guided to the outlet portion 143 along the connection passage 134 formed by the connection portion 144 and the guide portion 154. The detergent guided to the outlet portion 143 may be discharged into the interior of the housing 110 through the outlet portion 143.

The pump connector 170 may be configured to provide power to the detergent pump 130. The pump connector 170 may be connected to an external connector (not shown) to provide power supplied from the external connector to the terminal 155 and the pump motor 164. The pump connector 170 may be mounted on the pumping device 160.

Referring to FIG. 8, the pump connector 170 may be electrically connected to the terminal 155 through the sensing wire 138. The pump connector 170 may be electrically connected to the pump motor 164 through a pump wire 137. The pump wire 137 may be located within the detergent pump 130. The pump wire 137 may be disposed within the pumping device 160.

Such a configuration may allow the configurations for detecting the remaining amount of detergent in the detergent container 120 of the washing machine 1 according to an embodiment of the present disclosure to be relatively simplified, thereby simplifying the manufacturing process and reducing material costs.

While the present disclosure has been particularly described with reference to exemplary embodiments, it should be understood by those of skilled in the art that various changes in form and details may be made without departing from the spirit and scope of the present disclosure.

What is claimed is:

1. A washing machine, comprising:

a cabinet;

a tub disposed in the cabinet; and a detergent supplier configured to supply detergent to the tub;

wherein the detergent supplier comprises:

a detergent container to store the detergent to be supplied, the detergent container including a detection hole; and a detergent pump dockable with the detergent container, the detergent pump comprising:

a first case including:

a detector configured to detect an amount of the detergent in the detergent container;

a detector insertion portion configured to be inserted into the detection hole of the detergent container based on the detergent pump being docked with the detergent container, one end of the detector being configured to pass through the detector insertion portion and be located inside the detergent container;

an inlet portion configured to allow the detergent to be introduced from the detergent container therethrough; and an outlet portion configured to allow the detergent introduced through the inlet portion to be discharged therethrough;

a second case coupled to the first case, the second case including a terminal electrically connectable to the detector; and a pump configured to introduce the detergent from the detergent container through the inlet portion and discharge the introduced detergent through the outlet portion.

2. The washing machine of claim 1, wherein the detergent pump includes a pump connector electrically connected to the terminal and mounted on the pump.

3. The washing machine of claim 2, wherein the pump includes a pump motor configured to generate power to introduce the detergent through the inlet portion and discharge the introduced detergent through the outlet portion, and the pump connector is electrically connected to the pump motor.

4. The washing machine of claim 3, wherein the detergent pump comprises:

a sensing wire disposed within the detergent pump to electrically connect the terminal and the pump connector, and a pump wire disposed within the detergent pump to electrically connect the pump motor and the pump connector.

5. The washing machine of claim 4, wherein the detector insertion portion is a first detector insertion portion, and wherein the terminal further comprises:

a second detector insertion portion located at one end of the terminal and into which the detector is inserted, and a wire fixing portion located at an other end of the terminal opposite to one end of the terminal where the first detector insertion portion is located and fixing the sensing wire.

6. The washing machine of claim 2, wherein the detector is configured to detect the amount of detergent in the detergent container based on current being generated by the pump connector.

7. The washing machine of claim 1, wherein the first case further includes a connection portion connecting the inlet portion and the outlet portion, and the second case further includes a guide portion that, together with the connection portion, forms a connection passage that guides the detergent introduced through the inlet portion to the outlet portion.

8. The washing machine of claim 7, wherein the detergent pump includes a passage sealer configured to seal the connection passage formed between the connection portion and the guide portion.

9. The washing machine of claim 1, wherein the detergent supplier includes a housing having an opening that allows the detergent container to be inserted and removed, and the detergent pump is mounted on the housing.

10. The washing machine of claim 9, wherein the outlet portion is configured to discharge the detergent introduced through the inlet portion into the housing.

11. The washing machine of claim 1, wherein the terminal further includes at least one support protrusion protruding from an inner circumferential surface into which the detector is inserted, the at least one support protrusion to contact the inserted detector to conduct current to the inserted detector.

12. The washing machine of claim 1, wherein the detergent pump includes a hole sealer disposed on an outer side of the detector, the hole sealer configured to seal the detection hole based on the detector insertion portion being inserted into the detection hole.

13. The washing machine of claim 1, wherein the pump includes a pump motor and a pumping portion configured to perform a pumping motion while the pump motor is operating, and the second case includes a pumping hole formed to communicate with the pumping portion.

14. The washing machine of claim 1, wherein the second case further includes a terminal mounting portion on which the terminal is mounted, and the terminal further includes a terminal support portion disposed inside of the terminal mounting portion to support the terminal.

15. A clothing treating apparatus, comprising:

a tub; and a detergent supplier configured to supply detergent to the tub;

wherein the detergent supplier comprises:

a detergent container to store the detergent to be supplied, the detergent container including a detection hole, and a detergent pump dockable with the detergent container, wherein the detergent pump comprises:

a first case including:

a detector to detect an amount of the detergent in the detergent container;

a detector insertion portion configured to be inserted into the detection hole of the detergent container based on the detergent pump being docked with the detergent container, one end of the detector being configured to pass through the first detector insertion portion and be located inside the detergent container; and an inlet portion configured to allow the detergent to be introduced from the detergent container therethrough, a second case coupled to the first case, the second case including a terminal electrically connectable to the detector, a pump configured to introduce the detergent from the detergent container through the inlet portion; and a pump connector configured to supply power to the terminal and the pump.

* * * * *